US010869803B1

(12) United States Patent
Cohn

(10) Patent No.: US 10,869,803 B1
(45) Date of Patent: Dec. 22, 2020

(54) CHIROPRACTIC ADJUSTMENT DEVICE

(71) Applicant: Robert A. Cohn, Columbus, OH (US)

(72) Inventor: Robert A. Cohn, Columbus, OH (US)

( * ) Notice: Subject to any disclaimer, the term of this patent is extended or adjusted under 35 U.S.C. 154(b) by 0 days.

(21) Appl. No.: 16/589,552

(22) Filed: Oct. 1, 2019

Related U.S. Application Data

(60) Provisional application No. 62/804,059, filed on Feb. 11, 2019.

(51) Int. Cl.
*A61H 1/00* (2006.01)
*A61H 1/02* (2006.01)

(52) U.S. Cl.
CPC ..... *A61H 1/008* (2013.01); *A61H 1/0292* (2013.01); *A61H 2201/0157* (2013.01); *A61H 2203/0468* (2013.01)

(58) Field of Classification Search
CPC ..... A61H 1/00; A61H 1/0292; A61H 1/0244; A61H 1/008; A61H 1/0218; A61H 2203/0468; A61H 2203/0443; A61H 2203/0456; A61H 2205/081; A61H 2205/088; A61H 2201/0157; A61H 2201/1284; A61H 2201/1628; A61H 2201/163; A61H 23/06; A61G 13/009
See application file for complete search history.

(56) References Cited

U.S. PATENT DOCUMENTS 1,398,150 A 11/1921 Pollard
3,901,222 A * 8/1975 Muramatsu ..... A61H 1/00 606/240
D246,816 S 1/1978 Tam et al.
4,126,129 A 11/1978 Rainbow
(Continued)

FOREIGN PATENT DOCUMENTS

EP 2779870 B1 1/2017

OTHER PUBLICATIONS

"Construction of DC Motor", electrical4u.com, archived on the web Jan. 16, 2017 pp. 1-4. https://web.archive.org/web/20170116070033/http://www.electrical4u.com/construction-of-dc-motor-yoke-poles-armature-field-winding-commutator-brushes-of-dc-motor/ (Year: 2017).*
"New Years Countdown Chiropractic Classifieds", Planet Chiropractic Webpage, Web page <https://planetc1.com/new-years-countdown-chiropractic-classifieds/>, 13 pages, dated Dec. 28, 2008, retrieved from www.planetc1.com website on Feb. 7, 2020.
(Continued)

*Primary Examiner* — Samchuan C Yao
*Assistant Examiner* — Matthew Standard
(74) *Attorney, Agent, or Firm* — The Law Office of Patrick F. O'Reilly, III, LLC

(57) ABSTRACT

A chiropractic adjustment device is disclosed herein. The chiropractic adjustment device includes a support board; a plurality of adjustment blocks slidably coupled to the support board, each of the adjustment blocks having a wedge-shaped body portion; and block positioning means, the block positioning means configured to establish predetermined displacement paths for each of the adjustment blocks so as to assist a user in the proper positioning of the adjustment blocks for a self-administered pelvic adjustment of the user. In one or more embodiments, the block positioning means may comprise a plurality of tracks disposed in the support board. A first one of the tracks is configured to establish a first predetermined displacement path for a first one of the adjustment blocks, and a second one of the tracks is configured to establish a second predetermined displacement path for a second one of the adjustment blocks.

15 Claims, 11 Drawing Sheets

(56) References Cited

U.S. PATENT DOCUMENTS

| | | | | |
|---|---|---|---|---|
| 4,838,249 | A | 6/1989 | Jannotta | |
| 5,131,410 | A * | 7/1992 | Neill | A61G 7/07 5/657 |
| 5,222,979 | A | 6/1993 | Brossard | |
| 5,772,686 | A | 6/1998 | Caruana | |
| 6,389,624 | B1 * | 5/2002 | Madole | A47D 5/006 5/424 |
| 6,735,798 | B1 | 5/2004 | Sekizawa | |
| 6,821,260 | B2 | 11/2004 | Fors | |
| 7,320,668 | B1 | 1/2008 | Warder | |
| 8,439,948 | B1 * | 5/2013 | King | A61G 13/123 606/241 |
| 8,677,532 | B2 | 3/2014 | Legare | |
| 2002/0068888 | A1 | 6/2002 | Wang et al. | |
| 2003/0230310 | A1 * | 12/2003 | Day | A61F 5/01 128/845 |
| 2006/0037143 | A1 | 2/2006 | Green | |
| 2007/0123402 | A1 * | 5/2007 | Cantrell | A61H 1/0218 482/148 |
| 2009/0198276 | A1 | 8/2009 | Lee | |
| 2009/0270914 | A1 | 10/2009 | Heikkila | |

OTHER PUBLICATIONS

Chiropractic Techniques Webpage, Illawarra Chiropractic Clinic Website, Web page <http://www.illawarrachiro.com.au/techniques/>, 4 pages, dated Mar. 1, 2016, retrieved from Internet Archive Wayback Machine <https://web.archive.org/web/20160301184321/http://www.illawarrachiro.com.au/techniques/> on Feb. 7, 2020.

* cited by examiner

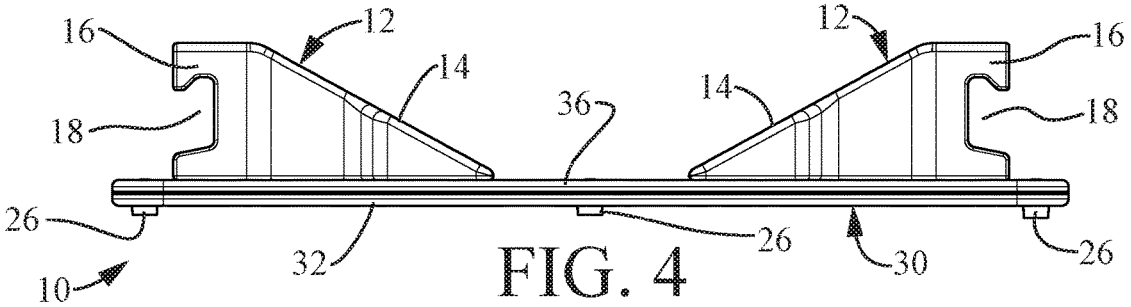
FIG. 4
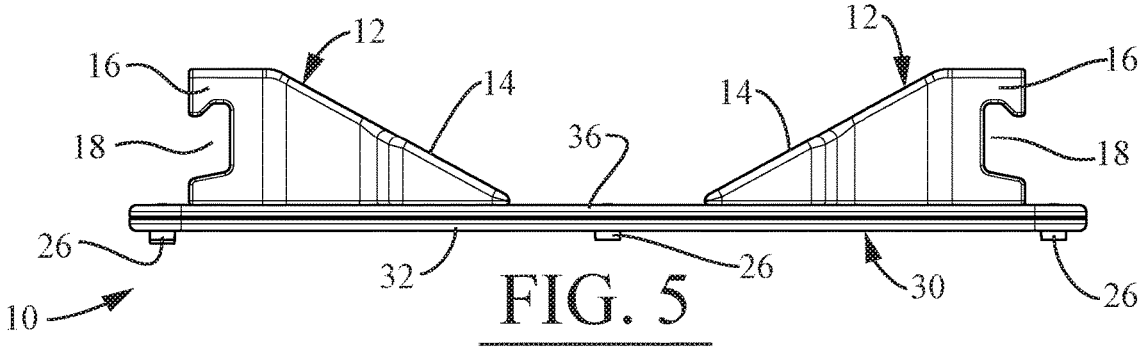
FIG. 5
FIG. 6
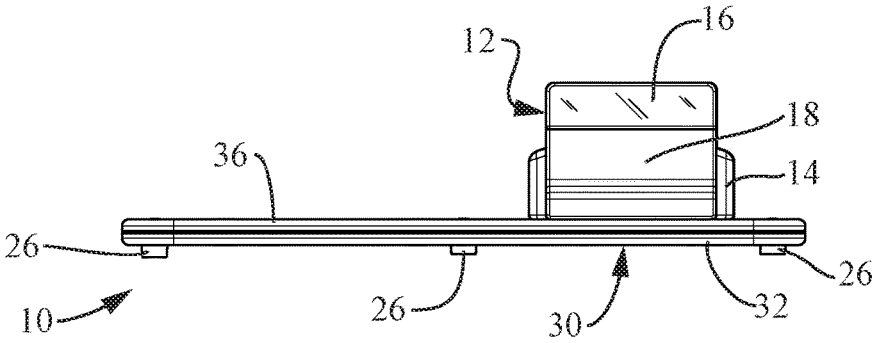
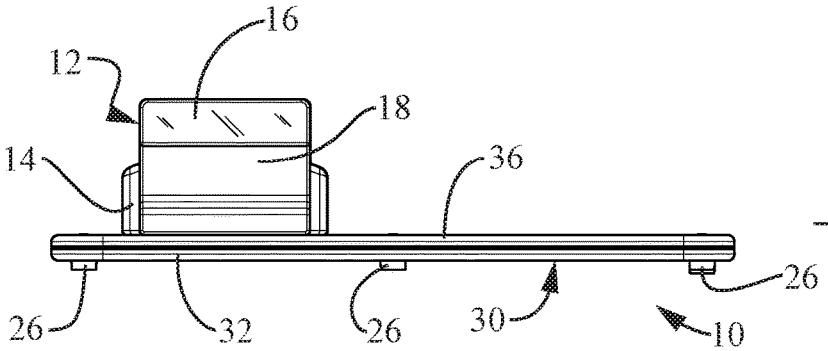
FIG. 7

Section A-A

Section B-B

CHIROPRACTIC ADJUSTMENT DEVICE

CROSS-REFERENCE TO RELATED APPLICATIONS

This patent application claims priority to, and incorporates by reference in its entirety, U.S. Provisional Patent Application No. 62/804,059, entitled "Chiropractic Adjustment Device", filed on Feb. 11, 2019.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a chiropractic adjustment device. More particularly, the invention relates to a chiropractic adjustment device that assists a user in the proper positioning of adjustment blocks for a self-administered pelvic adjustment.

2. Background

Because humans stand and move in an upright position, the most vulnerable portion of the spine is the lumbosacral junction in the pelvic area. A typical chiropractic adjustment for the lumbosacral junction in the pelvic area involves the application of a thrust force. However, because this thrust force could cause serious injury to the patient if misapplied, it must be performed by a trained practitioner (e.g., a chiropractor).

Although, because a patient may not be able to be treated by a chiropractor as frequently as desired, it would be highly advantageous if the patient could safely perform self-administered pelvic adjustments at home.

Therefore, what is needed is a chiropractic adjustment device that a patient is able to use for self-treating the lumbosacral area, specifically the pelvic joints. In addition, a chiropractic adjustment device is needed that assists a patient in the proper positioning of adjustment blocks for a self-administered pelvic adjustment.

BRIEF SUMMARY OF EMBODIMENTS OF THE INVENTION

Accordingly, the present invention is directed to a chiropractic adjustment device that substantially obviates one or more problems resulting from the limitations and deficiencies of the related art.

In accordance with one or more embodiments of the present invention, there is provided a chiropractic adjustment device that includes a support board; a plurality of adjustment blocks slidably coupled to the support board, each of the adjustment blocks having a wedge-shaped body portion; and block positioning means, the block positioning means configured to establish predetermined displacement paths for each of the adjustment blocks so as to assist a user in the proper positioning of the adjustment blocks for a self-administered pelvic adjustment of the user.

In a further embodiment of the present invention, the chiropractic adjustment device further comprises a plurality of connector members, each of the connector members configured to couple a respective one of the adjustment blocks to the support board.

In yet a further embodiment, at least one of the plurality of adjustment blocks comprises a handle portion for facilitating a grasping of the adjustment block by the user during the positioning of the adjustment block.

In still a further embodiment, at least one of the plurality of adjustment blocks comprises a hand recess formed therein for facilitating a grasping of the adjustment block by the user during the positioning of the adjustment block.

In yet a further embodiment, the block positioning means comprises a plurality of tracks disposed in the support board, a first one of the tracks configured to establish a first predetermined displacement path for a first one of the adjustment blocks, and a second one of the tracks configured to establish a second predetermined displacement path for a second one of the adjustment blocks.

In still a further embodiment, at least one of the plurality of tracks comprises at least one straight track portion, a curved track portion, and a diagonal track portion.

In yet a further embodiment, the plurality of tracks are configured so as to enable one of the adjustment blocks to be diagonally oriented relative to the other of the adjustment blocks.

In still a further embodiment, the block positioning means comprises a plurality of magnetic devices, a first one of the magnetic devices configured to guide a first one of the adjustment blocks along a first predetermined displacement path, and a second one of the magnetic devices configured to guide a second one of the adjustment blocks along a second predetermined displacement path.

In yet a further embodiment, the block positioning means comprises a plurality of electrical devices, a first one of the electrical devices configured to guide a first one of the adjustment blocks along a first predetermined displacement path, and a second one of the electrical devices configured to guide a second one of the adjustment blocks along a second predetermined displacement path.

In still a further embodiment, the support board comprises a first board section coupled to a second board section by a hinge member so as to enable the support board to be folded for compact storage and/or transportation of the chiropractic adjustment device.

In accordance with one or more other embodiments of the present invention, there is provided a chiropractic adjustment device that includes a support board; a plurality of adjustment blocks slidably coupled to the support board, each of the adjustment blocks having a wedge-shaped body portion; and a plurality of tracks disposed in the support board, each of the tracks configured to establish a predetermined displacement path for a respective one of the adjustment blocks so as to assist a user in the proper positioning of the adjustment blocks for a self-administered pelvic adjustment of the user.

In a further embodiment of the present invention, the chiropractic adjustment device further comprises a plurality of connector members, each of the connector members configured to couple a respective one of the adjustment blocks to the support board.

In yet a further embodiment, at least one of the plurality of adjustment blocks comprises a handle portion for facilitating a grasping of the adjustment block by the user during the positioning of the adjustment block.

In still a further embodiment, at least one of the plurality of adjustment blocks comprises a hand recess formed therein for facilitating a grasping of the adjustment block by the user during the positioning of the adjustment block.

In yet a further embodiment, at least one of the plurality of tracks comprises at least one straight track portion, a curved track portion, and a diagonal track portion.

In still a further embodiment, the plurality of tracks are configured so as to enable a first one of the adjustment blocks to be diagonally oriented relative to a second one of the adjustment blocks.

In yet a further embodiment, the first one of the adjustment blocks is configured to be diagonally oriented relative to the second one of the adjustment blocks at an approximately 45 degree angle.

In still a further embodiment, the support board comprises a first board section coupled to a second board section by a hinge member so as to enable the support board to be folded for compact storage and/or transportation of the chiropractic adjustment device.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which:

FIG. 4 is a front elevational view of the chiropractic adjustment device of FIG. 1;

FIG. 5 is a rear elevational view of the chiropractic adjustment device of FIG. 1;

FIG. 6 is a first side elevational view of the chiropractic adjustment device of FIG. 1;

FIG. 7 is a second side elevational view of the chiropractic adjustment device of FIG. 1;

Throughout the figures, the same parts are always denoted using the same reference characters so that, as a general rule, they will only be described once.

DETAILED DESCRIPTION OF EMBODIMENTS OF THE INVENTION

Figure 1:
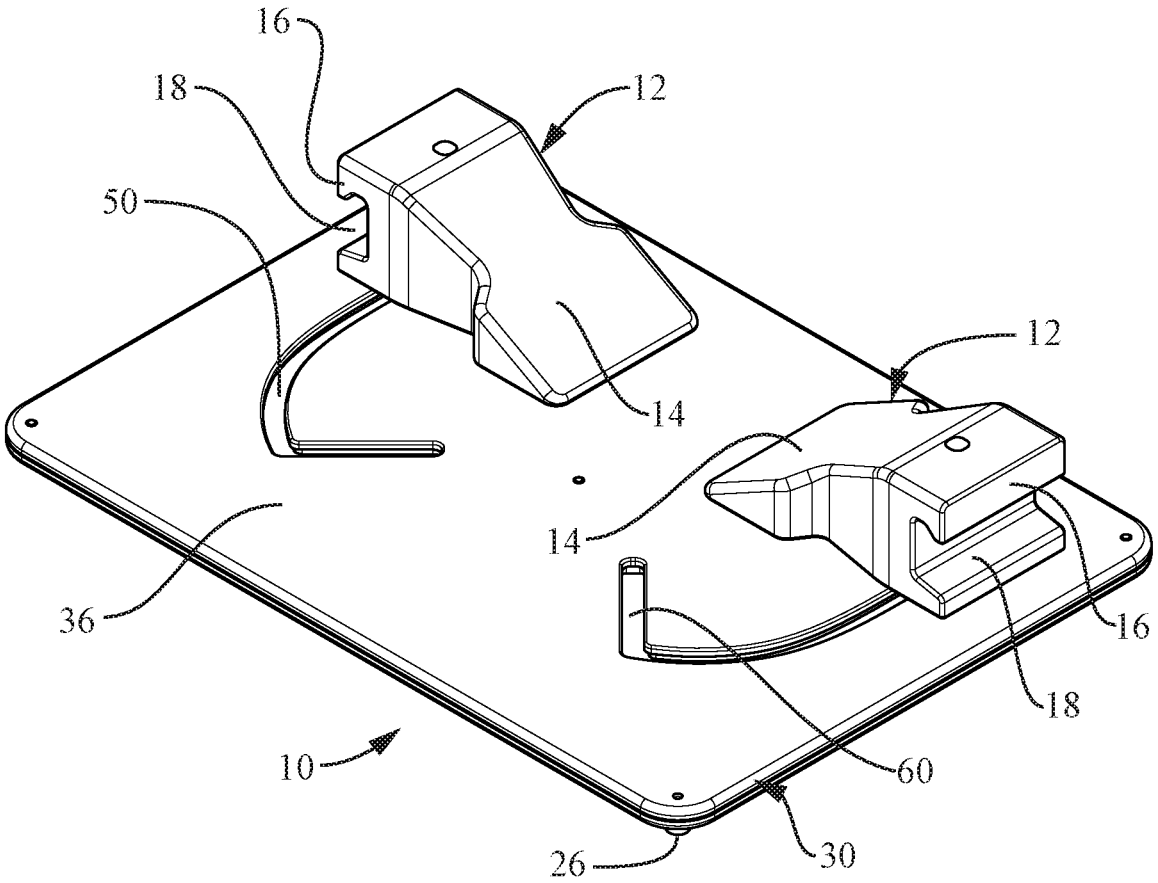
FIG. 1 is a top-side perspective view of a chiropractic adjustment device, according to an illustrative embodiment of the invention.
Figure 2:
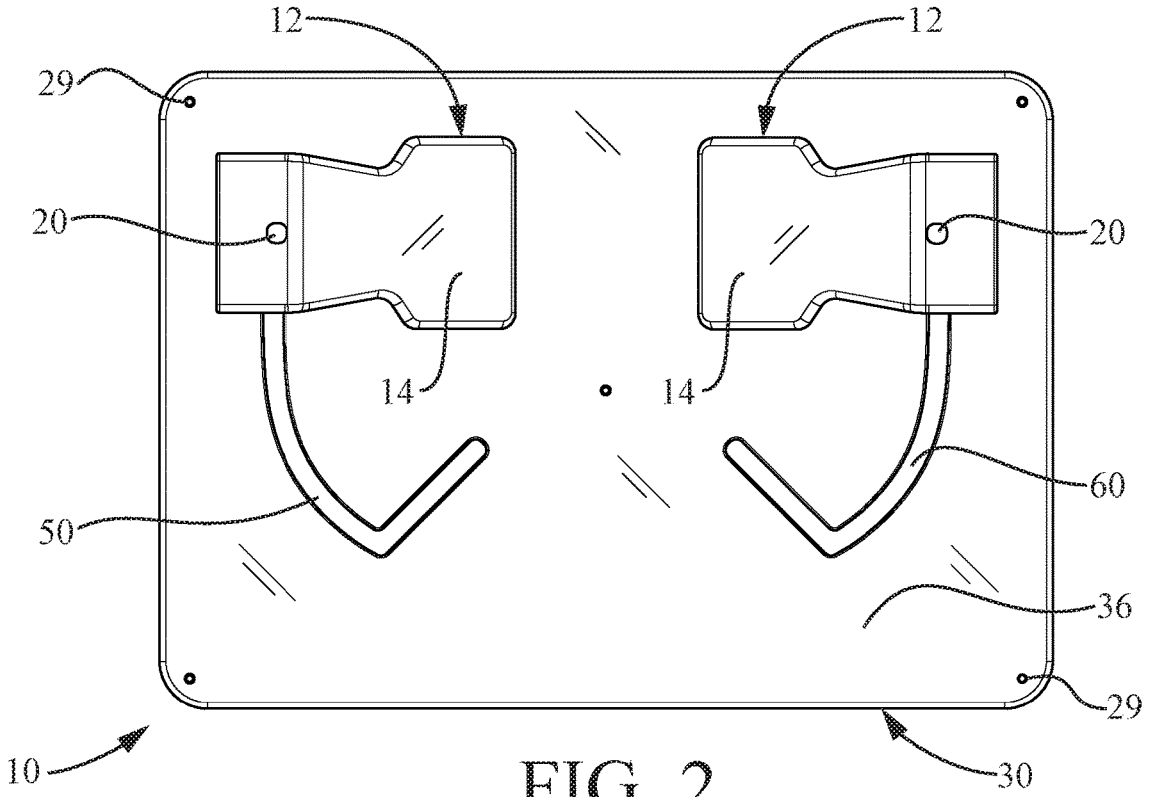
FIG. 2 is a top plan view of the chiropractic adjustment device of FIG. 1.

An illustrative embodiment of a chiropractic adjustment device is seen generally at 10 in FIGS. 1-11. With initial reference to FIGS. 1 and 2, the chiropractic adjustment device 10 generally comprises a support board 30; a plurality of adjustment blocks 12 slidably coupled to the support board 30, each of the adjustment blocks 12 having a wedge-shaped body portion 14; and block positioning means 50, 60, the block positioning means 50, 60 configured to establish predetermined displacement paths for each of the adjustment blocks 12 so as to assist a user in the proper positioning of the adjustment blocks for a self-administered pelvic adjustment of the user. In the illustrative embodiment, the block positioning means 50, 60 comprises a plurality of tracks 50, 60 disposed in the support board 30. As shown in FIGS. 1 and 2, a first one 50 of the tracks 50, 60 is configured to establish a first predetermined displacement path for a first one of the adjustment blocks 12, and a second one 60 of the tracks 50, 60 is configured to establish a second predetermined displacement path for a second one of the adjustment blocks 12.

Figure 9:
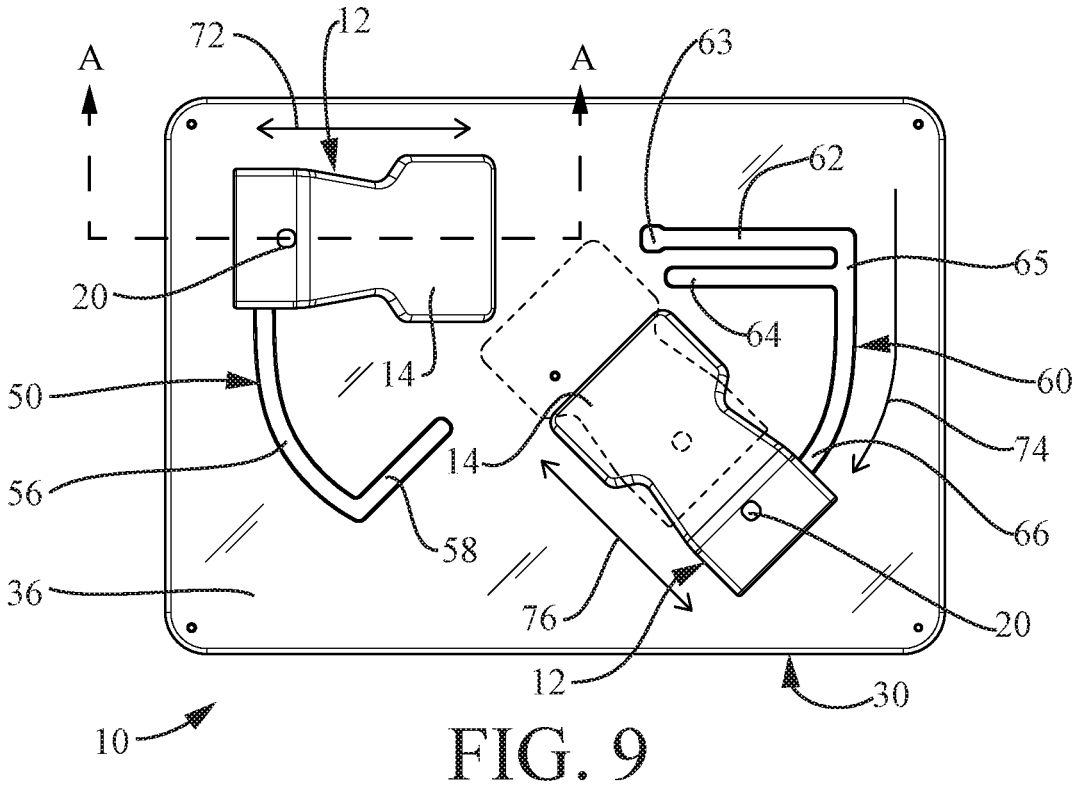
FIG. 9 is another top plan view of the chiropractic adjustment device of FIG. 1, wherein the adjustment blocks are oriented in a first pelvic adjustment position for treating right sacroiliac joint pain.
Figure 10:
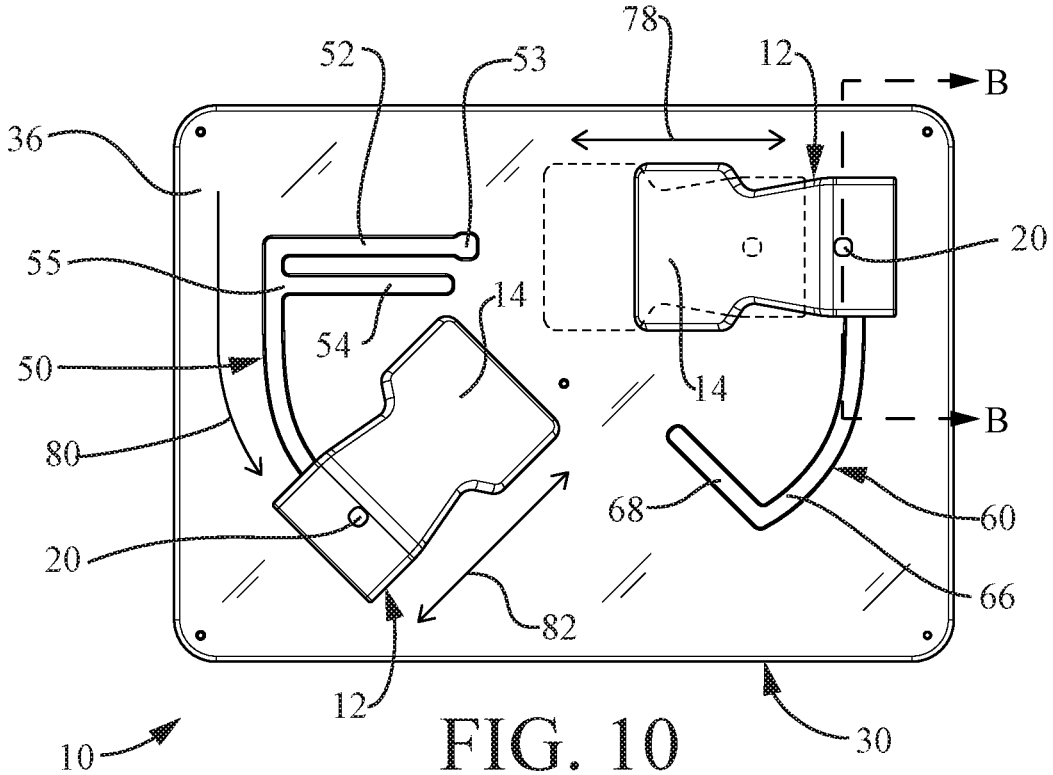
FIG. 10 is yet another top plan view of the chiropractic adjustment device of FIG. 1, wherein the adjustment blocks are oriented in a second pelvic adjustment position for treating left sacroiliac joint pain.
Figure 11:
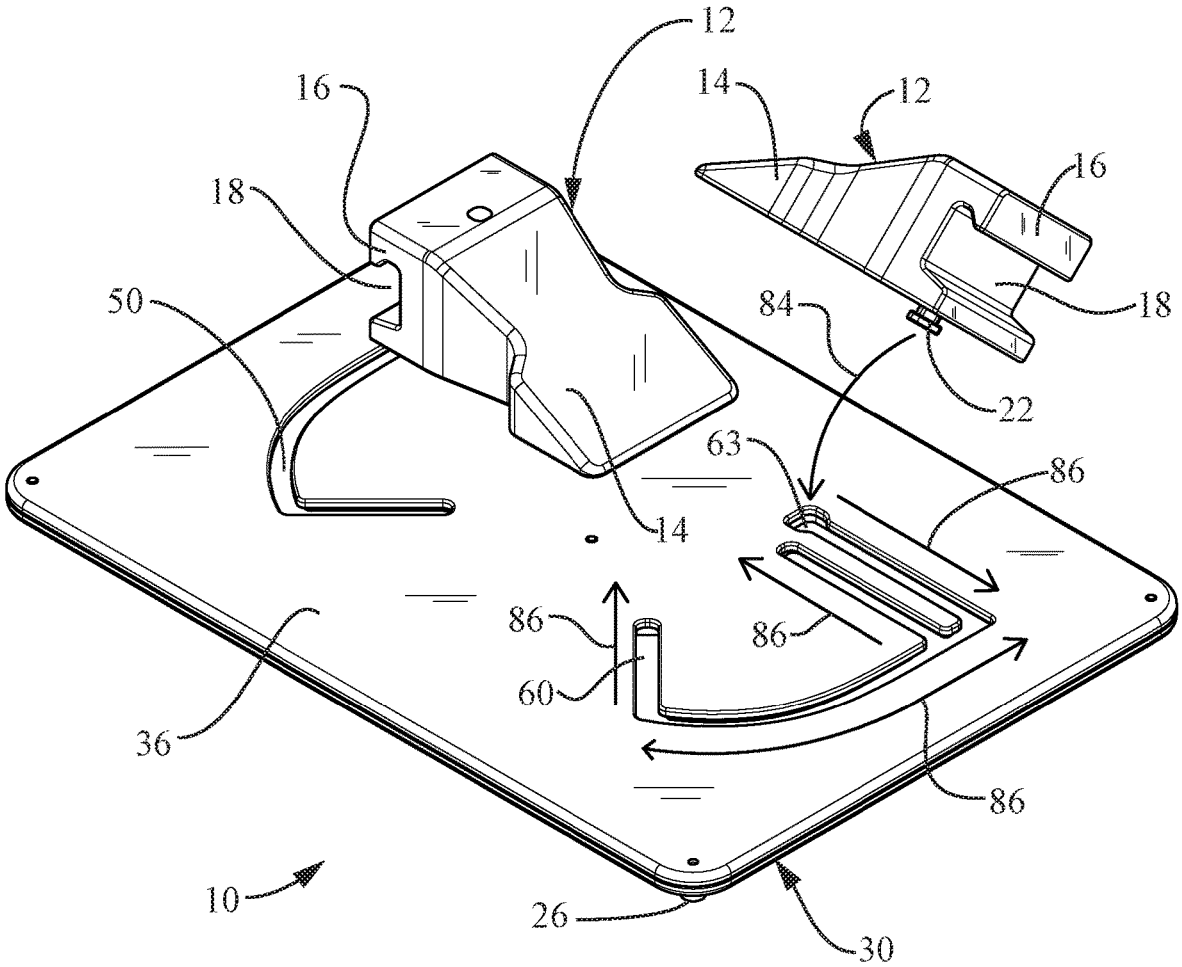
FIG. 11 is another top-side perspective view of the chiropractic adjustment device of FIG. 1, wherein an insertion of the post of one of the adjustment blocks is illustrated.

In the illustrative embodiment, with reference primarily to FIGS. 9 and 10, it can be seen that the first one 50 of the tracks 50, 60 comprises two straight track portions 52, 54 for selective placement of the first one of the adjustment blocks 12, a connecting track portion 55 that connects the ends of the straight track portions 52, 54, a curved track portion 56, and a diagonal track portion 58 for selective placement of the first one of the adjustment blocks 12. The curved track portion 56 connects the diagonal track portion 58 to the remainder of the track portions 52, 54, 55. Similarly, in the illustrative embodiment, it can be seen that the second one 60 of the tracks 50, 60 comprises two straight track portions 62, 64 for selective placement of the second one of the adjustment blocks 12, a connecting track portion 65 that connects the ends of the straight track portions 62, 64, a curved track portion 66, and a diagonal track portion 68 for selective placement of the second one of the adjustment blocks 12. The curved track portion 66 connects the diagonal track portion 68 to the remainder of the track portions 62, 64, 65. In FIGS. 9 and 10, the arrows 72, 74, 76, 78, 80, 82 indicate predetermined displacement paths for the adjustment blocks 12 so that the adjustment blocks 12 may be properly positioned for performing different adjustments on the user. More specifically, the directional arrow 72 diagrammatically represents the displacement of the first adjustment block 12 along the first straight track portion 52, the curved directional arrow 80 diagrammatically represents the displacement of the first adjustment block 12 along the curved track portion 56, and the directional arrow 82 diagrammatically represents the displacement of the first adjustment block 12 along the diagonal track portion 58. Similarly, the directional arrow 78 diagrammatically represents the displacement of the second adjustment block 12 along the first straight track portion 62, the curved directional arrow 74 diagrammatically represents the displacement of the second adjustment block 12 along the curved track portion 66, and the directional arrow 76 diagrammatically represents the displacement of the second adjustment block 12 along the diagonal track portion 68. In FIG. 11, the possible displacement paths of the second adjustment block 12 are further diagrammatically depicted by the arrows 86.

Figure 14:
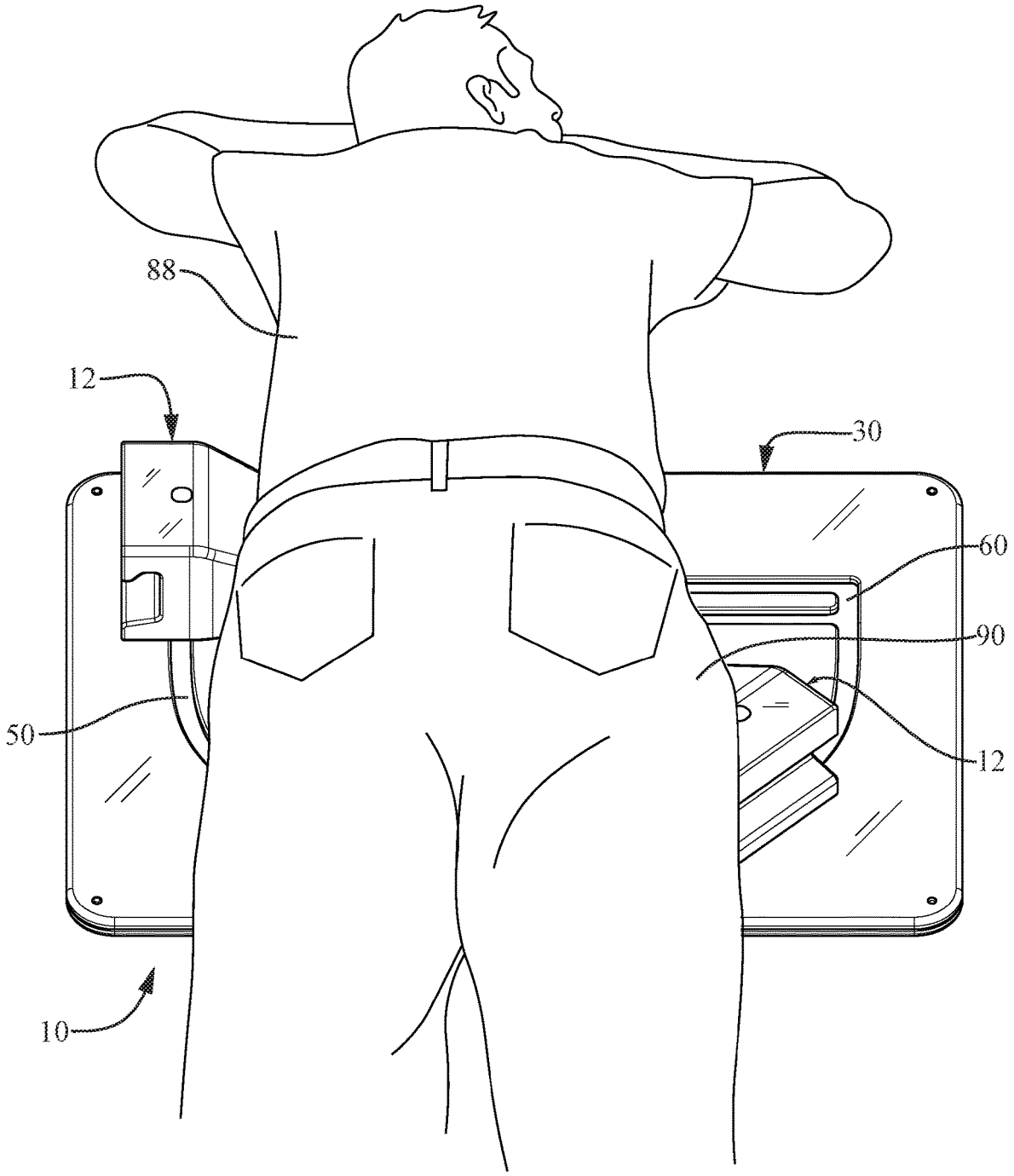
FIG. 14 is a top perspective view of a user lying face down on the chiropractic adjustment device of FIG. 1.

In FIG. 9, the adjustment blocks 12 are oriented in a first typical pelvic adjustment position for treating right sacroiliac joint pain (e.g., resulting from a right functionally short leg). When the user has a larger pelvis size, the first adjustment block 12 may be positioned in the first straight track portion 52 (i.e., upper straight track portion 52), which results in a larger spacing distance between the adjustment blocks 12. Conversely, when the user has a smaller pelvis size (e.g., a petite pelvis), the first adjustment block 12 may be positioned in the second straight track portion 54 (i.e., lower straight track portion 54), which results in a smaller spacing distance between the adjustment blocks 12. In FIG. 14, a user 88 is depicted lying face down on the chiropractic adjustment device 10 with the adjustment blocks 12 of the device 10 being oriented in the pelvic adjustment positions for treating right sacroiliac joint pain in the pelvic area 90 of the user 88.

In FIG. 10, the adjustment blocks 12 are oriented in a second typical pelvic adjustment position for treating left sacroiliac joint pain (e.g., resulting from a left functionally short leg). When the user has a larger pelvis size, the second adjustment block 12 may be positioned in the first straight track portion 62 (i.e., upper straight track portion 62), which results in a larger spacing distance between the adjustment blocks 12. Conversely, when the user has a smaller pelvis size (e.g., a petite pelvis), the second adjustment block 12 may be positioned in the second straight track portion 64 (i.e., lower straight track portion 64), which results in a smaller spacing distance between the adjustment blocks 12.

FIGS. 9 and 10 represent the two most common ways to use the chiropractic adjustment device 10 for pelvic adjustments. As shown in these two figures, the tracks 50, 60 are configured so as to enable one of the adjustment blocks 12 to be diagonally oriented relative to the other of the adjustment blocks 12 (i.e., the diagonal track portions 58, 68 enable one of the adjustment blocks 12 to be diagonally oriented relative to the other of the adjustment blocks 12). Referring again to FIGS. 9 and 10, it can be seen that, in the illustrated embodiment, the first straight track portion 52 is substantially parallel, or parallel to the second straight track portion 54, while the first straight track portion 62 is substantially parallel, or parallel to the second straight track portion 64. Also, in the illustrated embodiment, each of the straight track portions 52, 54 are substantially perpendicular, or perpendicular to the connecting track portion 55, while each of the straight track portions 62, 64 are substantially perpendicular, or perpendicular to the connecting track portion 65. In addition, as shown in FIGS. 9 and 10, when the adjustment blocks 12 are disposed in their typical pelvic adjustment positions, the first one of the adjustment blocks 12 is configured to be diagonally oriented relative to the second one of the adjustment blocks 12 at an approximately 45 degree angle (i.e., the longitudinal axes of the first and second adjustment blocks 12 are oriented relative to one another at an approximately 45 degree angle).

Figure 8:
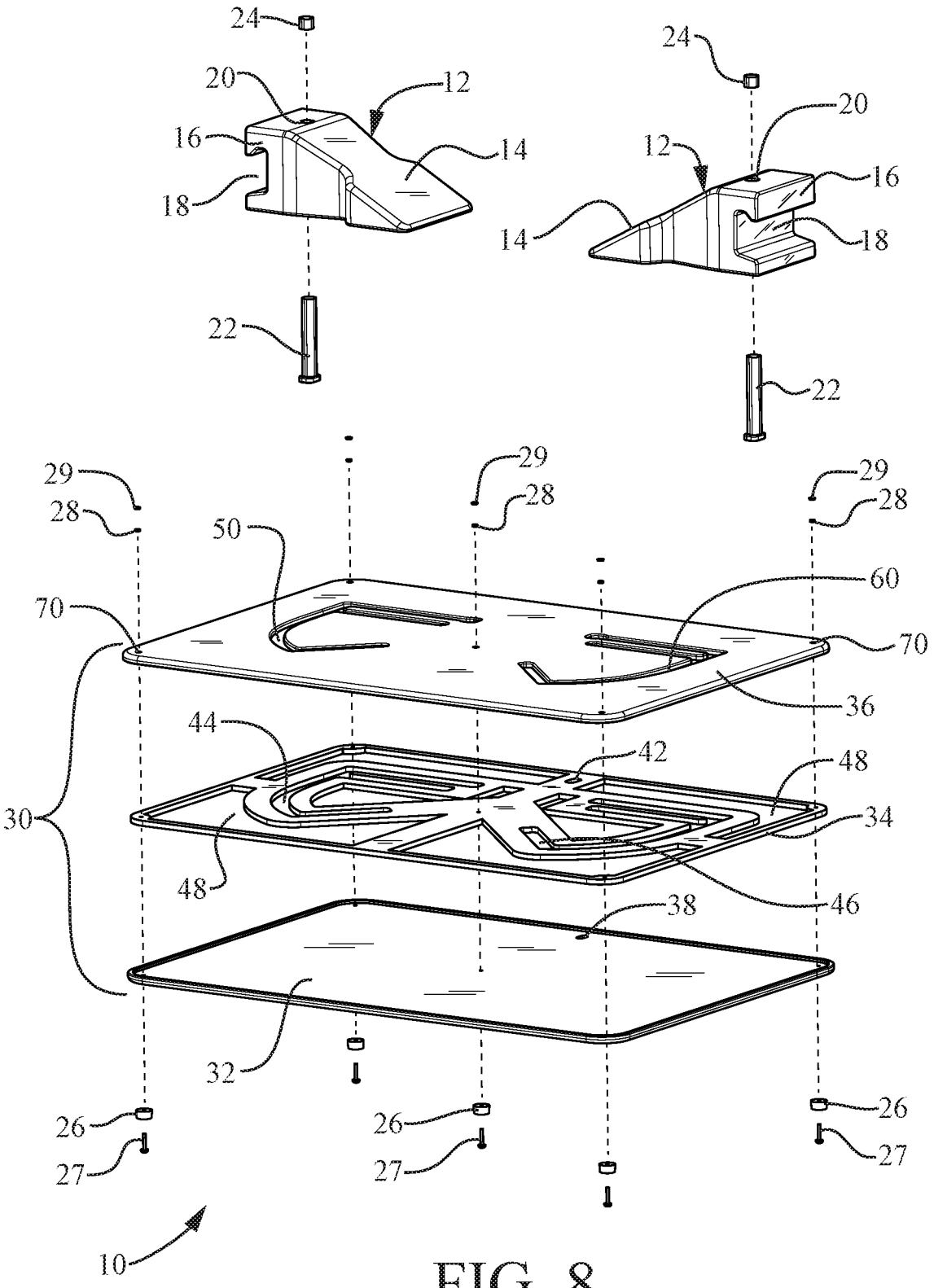
FIG. 8 is an overall exploded perspective view of the chiropractic adjustment device of FIG. 1.

Now, with reference primarily to FIGS. 1, 8, and 11, the adjustment blocks 12 of the chiropractic adjustment device 10 will be described in more detail. In the illustrative embodiment, each of the adjustment blocks 12 comprises a generally wedged-shaped body portion 14 with a handle portion 16 for facilitating a grasping of the adjustment block 12 by the user during the positioning of the adjustment block 12. In the illustrative embodiment, the handle portion 16 of each adjustment block 12 may integrally formed with the wedged-shaped body portion 14. As shown in FIGS. 1, 8, and 11, each of the adjustment blocks 12 may further comprise a hand recess 18 formed therein below the handle portion 16, which also facilitates a grasping of the adjustment block 12 by the user during the positioning of the adjustment block 12 by enabling the user to more easily grasp the handle portion 16.

Figure 12:
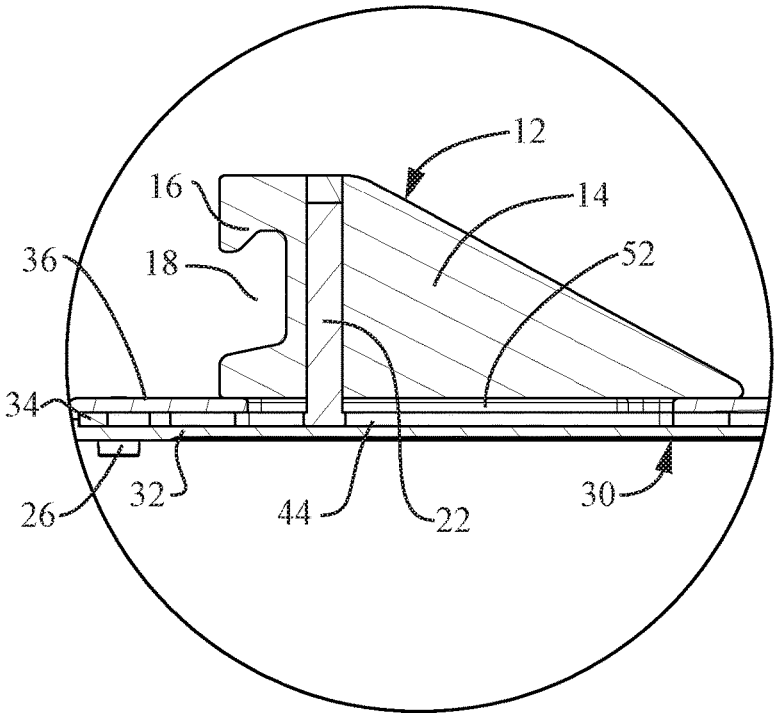
FIG. 12 is a partial sectional view cut through a first one of the adjustment blocks and the support board of the chiropractic adjustment device, wherein the section is generally cut along the cutting-plane line A-A in FIG. 9.
Figure 13:
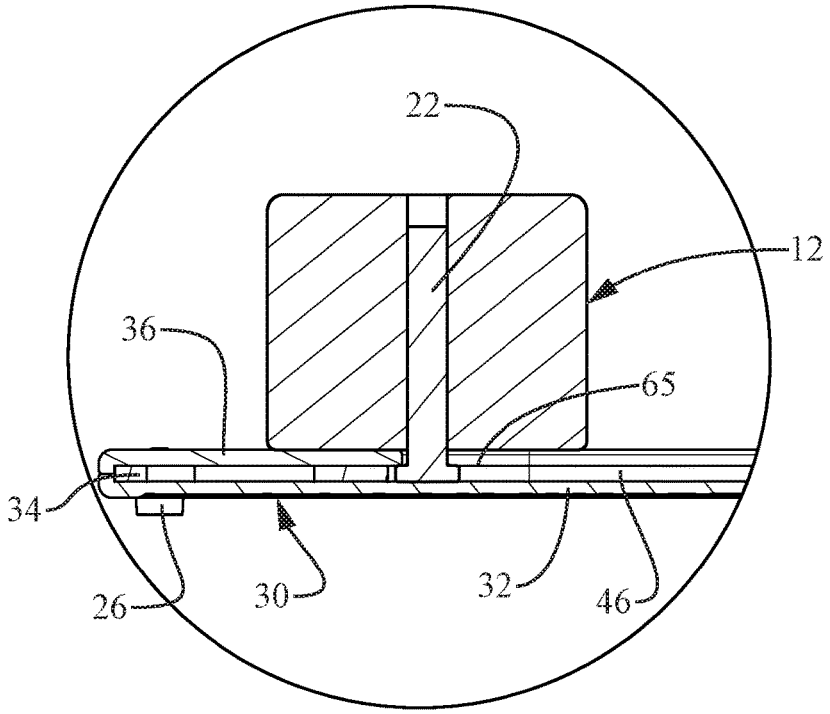
FIG. 13 is a partial sectional view cut through a second one of the adjustment blocks and the support board of the chiropractic adjustment device, wherein the section is generally cut along the cutting-plane line B-B in FIG. 10.

As best shown in FIGS. 8 and 11, the chiropractic adjustment device 10 further comprises a plurality of connector members 22 (i.e., posts 22) for coupling respective ones of the adjustment blocks 12 to the support board 30. More specifically, as shown in the exploded view of FIG. 8, each of the adjustment blocks 12 comprises an aperture 20 formed therethrough for receiving a connector post 22. Once the connector post 22 is inserted into the aperture 20 of the adjustment blocks 12, the top end of the aperture 20 is capped with a plug 24 so that the top surface of the adjustment block 12 is generally continuous. Then, as shown in FIG. 11, the bottom end of the connector post 22 is inserted into the enlarged end portion 53 or 63 of the straight track portion 52 or 62. In FIG. 11, the insertion of the connector post 22 into the enlarged end portion 63 of the straight track portion 62 is diagrammatically indicated by the arrow 84. As shown in FIGS. 8 and 11, in the illustrative embodiment, the bottom end of each connector post 22 has an outwardly protruding rim, which is inserted into a respective enlarged end portion 53, 63 of a respective track 50, 60. Referring to FIG. 8, the middle layer 34 of the support board 30 has first and second tracks 44, 46 that are aligned with, and correspond to tracks 50, 60 in the top layer 36 of the support board 30. However, in the illustrative embodiment, the first and second tracks 44, 46 in the middle layer 34 of the support board 30 have a slightly larger cross-sectional width than the cross-sectional width of tracks 50, 60 in the top layer 36 of the support board 30 (e.g., the tracks 44, 46 are approximately ¼" wider than tracks 50, 60) so that the outwardly protruding rims of the connector posts 22 are able to be slidingly displaced in the tracks 44, 46, but still retain their respective adjustment blocks 12 in engagement with the support board 30. For example, as shown in the section views of FIGS. 12 and 13, by virtue of the outwardly protruding rim at the bottom end of each connector post 22, each connector post 22 is able to slide in the tracks 44, 46 of the middle layer 34, but is constrained in an axial direction between the bottom and top layers 32, 36 of support board 30 such that the adjustment blocks 12 are not able to be removed from the support board 30 unless their connector posts 22 are vertically aligned with the enlarged end portions 53, 63 of the straight track portions 52, 62, which then allows the bottom end of the connector posts 22 to be pulled out of the tracks 50, 60.

In an alternative embodiment, the support board of the chiropractic adjustment device 10 may be provided with only two (2) layers, rather than the three (3) layers 32, 34, 36 of the illustrative embodiment. In this alternative embodiment, the top layer of the two-piece support board comprises the tracks 50, 60, while the bottom layer of the two-piece support board comprises grooves that correspond to the tracks 50, 60. The grooves in the bottom layer of the two-piece support board accommodate the outwardly protruding rim at the bottom end of each connector post 22. In this alternative embodiment, the support board of the chiropractic adjustment device 10 does not include a middle layer.

In another alternative embodiment, rather than being removable from support board 30, the connector posts 22 of the adjustment blocks 12 may be permanently trapped in the support board 30 such that the adjustment blocks 12 are displaceable, but cannot be removed from the support board 30. For example, in this alternative embodiment, the enlarged end portions 53, 63 of the straight track portions 52, 62 may be omitted from the top layer 36 of the support board 30 such that the outwardly protruding rim at the bottom end of each connector post 22 is permanently trapped in the support board 30, thereby preventing the removal of the adjustment blocks 12 from the support board 30.

In yet another alternative embodiment, the bottom bounding surfaces of the tracks 44, 46 may be provided with a material having a low coefficient of friction (e.g., a solid or spray-on silicone material with a low coefficient of friction) so that the connector posts 22 of the adjustment blocks 12 glide more freely within the tracks 44, 46, 50, 60.

In the illustrative embodiment, the generally wedged-shaped body portion 14 of each adjustment block 12 may be formed from a suitable closed cell foam material (see e.g., FIGS. 12 and 13) of sufficient rigidity such that the closed cell foam material generally maintains its shape when the user lays face down on the chiropractic adjustment device 10. Also, in the illustrative embodiment, the connector post 22 and plug 24 of each adjustment block 12 may be formed from a suitable plastic material. Also, in the illustrative embodiment, the body portion 14 of each adjustment block 12 may have a generally duck bill wedge shape (see e.g., FIG. 1).

Figure 15:
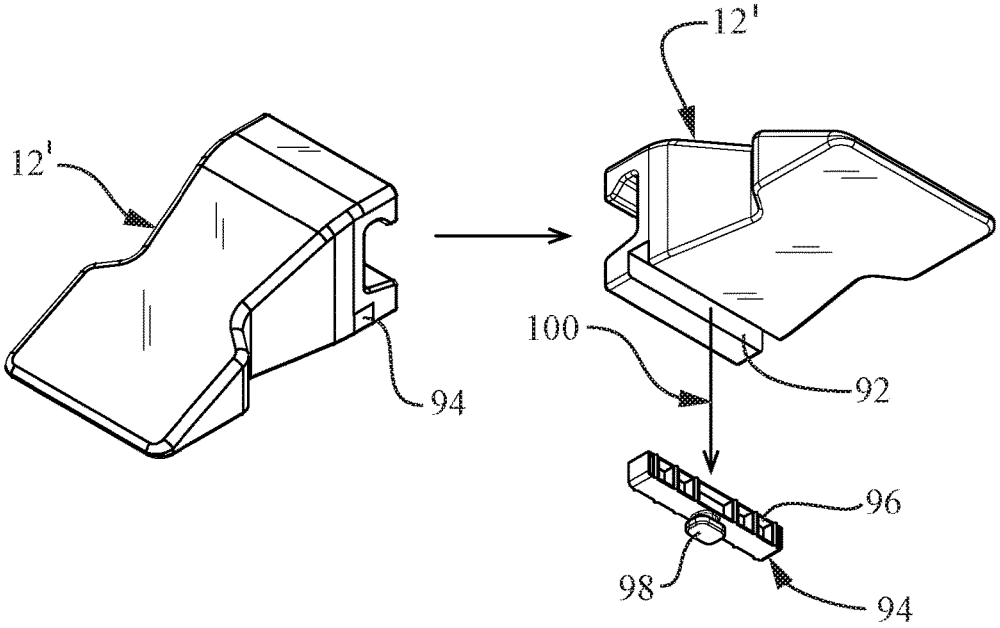
FIG. 15 is a perspective view depicting an alternative embodiment of the adjustment block of the chiropractic adjustment device of FIG. 1, wherein the adjustment block is provided with a removable post.
Figure 16:
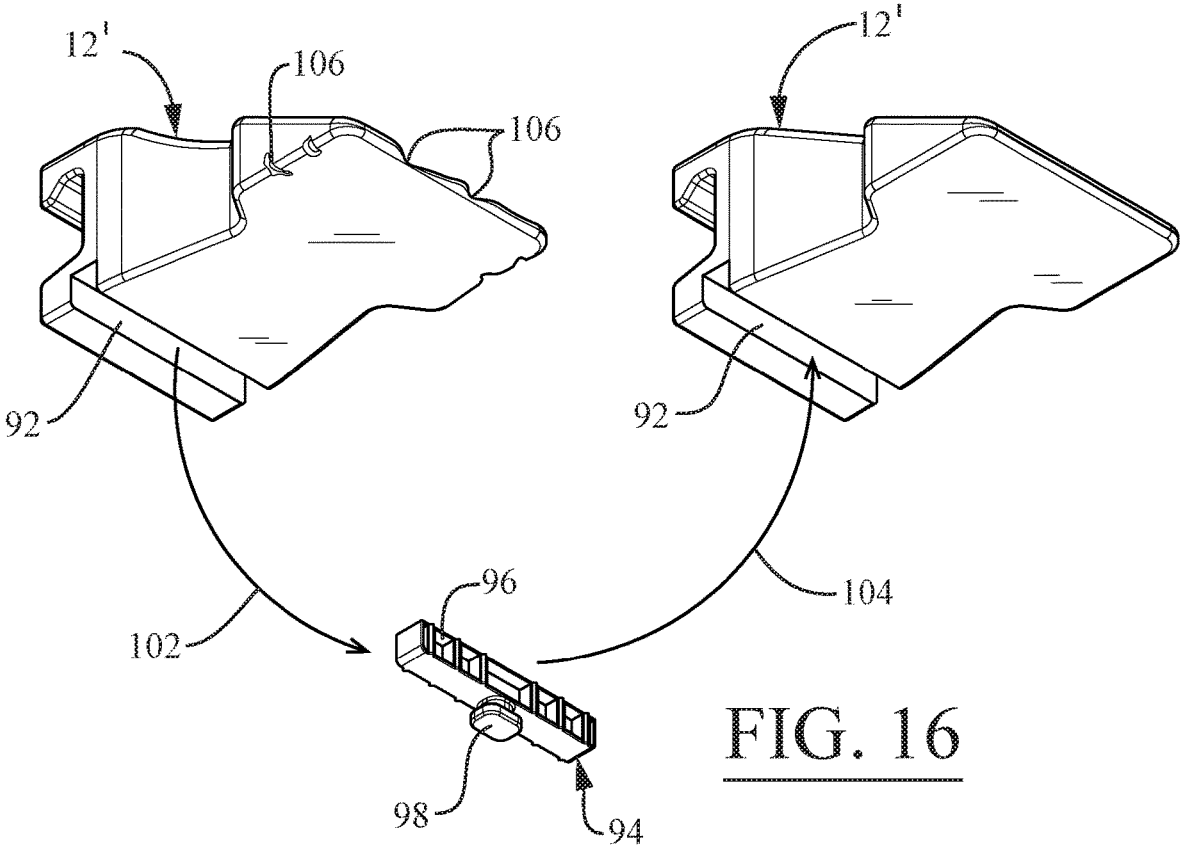
FIG. 16 is another perspective view of the alternative embodiment of the adjustment block of FIG. 15, wherein the removable post is shown being removed from a damaged adjustment wedge body portion, and being inserted into a new adjustment wedge body portion.

A first alternative embodiment of the adjustment block 12' of the chiropractic adjustment device 10 is depicted in FIGS. 15 and 16. In this alternative embodiment, the adjustment block 12' is similar to the adjustment block 12 described above, except that the adjustment block 12' of FIGS. 15 and 16 is provided with a removable post structure 94. As shown in these figures, the removable post structure 94 comprises a horizontal post support structure 96 and a post member 98 that extends from the bottom side of the horizontal post support structure 96. The horizontal post support structure 96 of the removable post structure 94 is received within a transverse slot 92 disposed in the bottom of the adjustment block 12'. On the right side of FIG. 15, post structure 94 is shown being removed from the slot 92 in the bottom of the adjustment block 12' (as diagrammatically indicated by the arrow 100 in FIG. 15). In FIG. 16, the post structure 94 is shown being removed from the slot 92 of an adjustment block 12' with damaged body portions 106 (as diagrammatically indicated by the arrow 102 in FIG. 16), and then being inserted into the slot 92 of a new adjustment wedge body portion (as diagrammatically indicated by the arrow 104 in FIG. 16). Advantageously, in the alternative embodiment of FIGS. 15 and 16, when the material (e.g., foam) forming the wedge-shaped body portion of the adjustment block 12' becomes damaged, the post structure 94 can be removed from the damaged block body portion, and then reused in a new block body portion so that the post structure 94 is not required to be discarded with the damaged block body portion of the adjustment block 12'.

Figure 17:
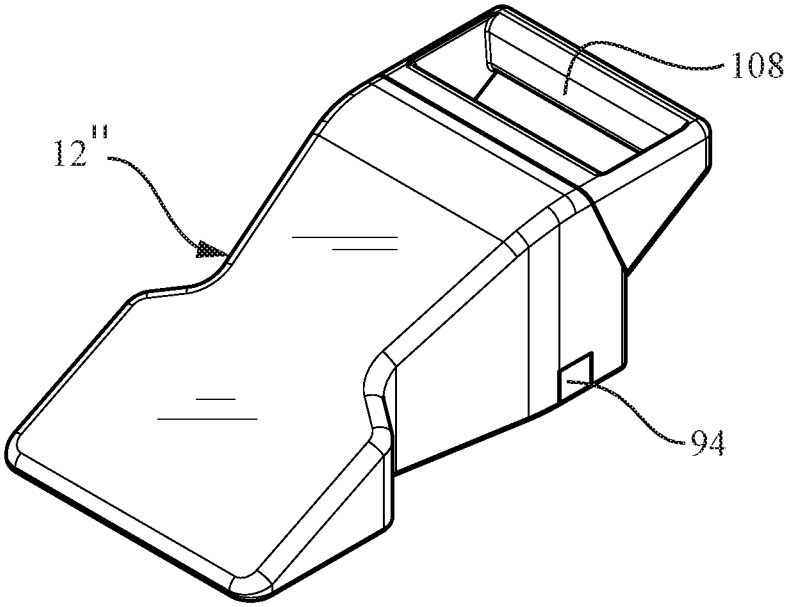
FIG. 17 is a perspective view depicting another alternative embodiment of the adjustment block of the chiropractic adjustment device of FIG. 1, wherein the adjustment block is provided with a protruding handle portion.

A second alternative embodiment of the adjustment block 12" of the chiropractic adjustment device 10 is depicted in FIG. 17. In this alternative embodiment, the adjustment block 12" is similar to the adjustment block 12 described above, except that the adjustment block 12" of FIG. 17 is provided with a protruding handle portion 108 that may be easier for some users to grasp than the handle portion 16 of the adjustment block 12. In the alternative embodiment of FIG. 17, the protruding handle portion 108 of the adjustment block 12" may be formed from a suitable polymeric material or plastic, while the body portion of the adjustment block 12" may be formed from a suitable foam material.

Figure 18:
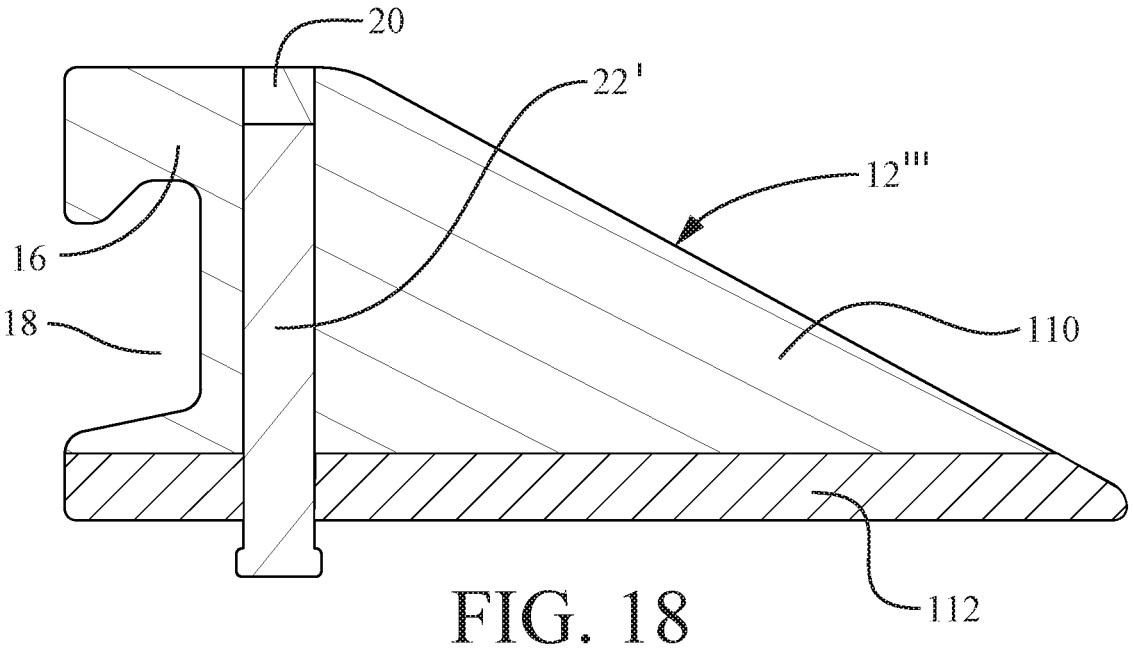
FIG. 18 is a perspective view depicting yet another alternative embodiment of the adjustment block of the chiropractic adjustment device of FIG. 1, wherein the body portion of the adjustment block is formed using foam materials have two different densities.

A third alternative embodiment of the adjustment block 12''' of the chiropractic adjustment device 10 is depicted in FIG. 18. In this alternative embodiment, the adjustment block 12''' is similar to the adjustment block 12 described above, except that the adjustment block 12''' of FIG. 18 is formed using foam materials having two different densities. More specifically, the upper body portion 110 of the adjustment block 12''' is formed using a lower density foam material, while the lower body portion 112 of the adjustment block 12''' is formed using a higher density foam material. As such, the upper body portion 110 of the adjustment block 12''', which contacts the user, is more compliant than the lower body portion 112. Also, in the alternative embodiment of FIG. 18, the connector post 22' may be formed using a foam material, rather than plastic, as described above for the adjustment block 12. In this alternative embodiment, the foam material forming the connector post 22' may have a higher density than the foam material forming the lower body portion 112 of the adjustment block 12''' so that the connector post 22' is sufficiently rigid (i.e., the foam material forming connector post 22' has the highest density of all the foam types used in the adjustment block 12''').

In an alternative embodiment, rather than the generally wedged-shaped body portion 14 of each adjustment block 12 being formed from a suitable closed cell foam material, the generally wedged-shaped body portion 14 of each adjustment block 12 may be formed from a suitable wood material. In this alternative embodiment, a piece of low density foam material may be provided on the top surface of the wood body portion of each block 12 for cushioning the user of the chiropractic adjustment device 10, while a thin piece of high density foam material may be provided on the bottom surface of the wood body portion of each block 12 for increasing the frictional contact of the adjustment block 12 with the support board 30, particularly when the thin piece of high density foam material is compressed by the weight on the user on the block 12.

Figure 3:
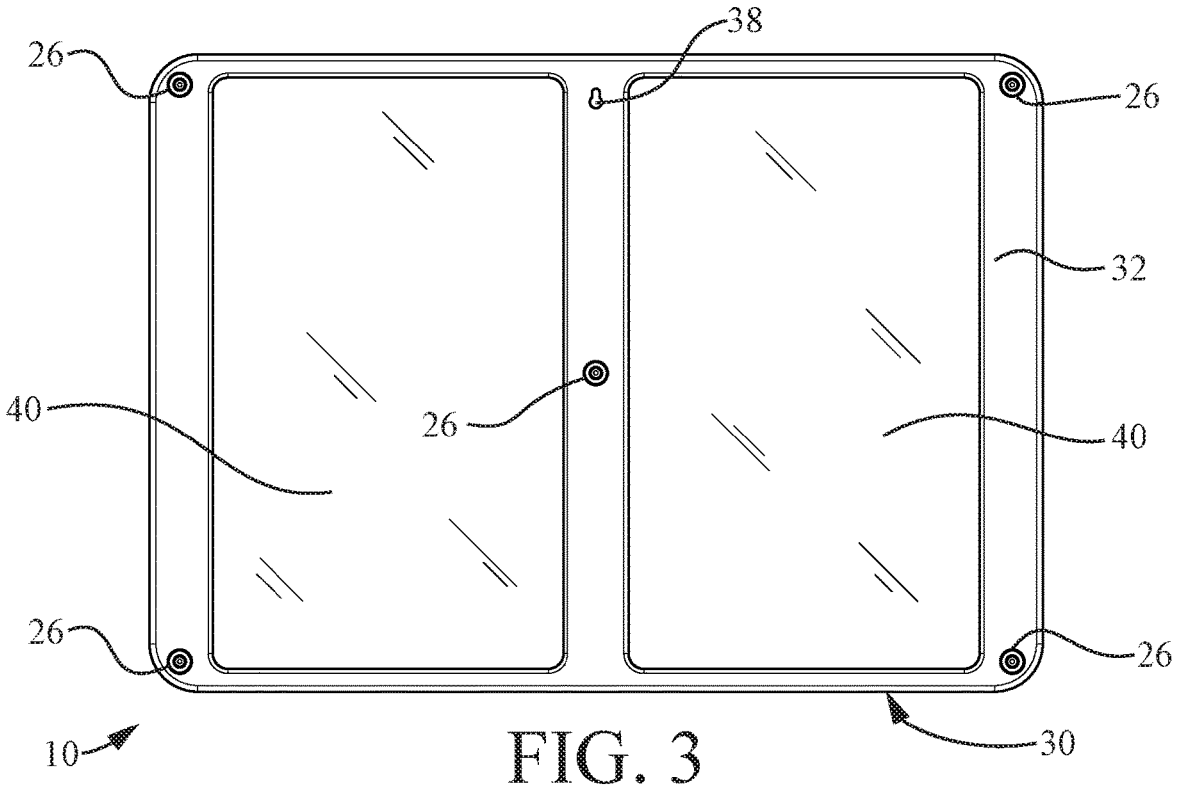
FIG. 3 is a bottom plan view of the chiropractic adjustment device of FIG. 1.

Next, with reference primarily to FIGS. 1, 8, and 11, the support board 30 of the chiropractic adjustment device 10 will be described in further detail. As mentioned above, in the illustrative embodiment, the support board 30 comprises a bottom layer 32, a middle layer 34, and a top layer 36. In the illustrative embodiment, the middle layer 34 of the support board 30 is sandwiched between the bottom layer 32 and the top layer 36 (see e.g., FIGS. 12 and 13). In the illustrative embodiment, the bottom layer 32 of the support board 30 comprises a keyhole-shaped aperture 38 for receiving a hook used to hang the chiropractic adjustment device 10 on a wall when it is not being used (see FIGS. 3 and 8). Also, as shown in FIG. 3, the bottom layer 32 of the support board 30 may comprise recessed areas 40 so as to reduce the thickness of the bottom layer 32 for overall weight reduction of the support board 30. In addition, the recessed areas 40 of the bottom layer 32 of the support board 30 may also be used for accommodating instructional sheets that inform the user on how to properly use the chiropractic adjustment device 10 for pelvic adjustments. Referring again to FIG. 8, in the illustrative embodiment, the middle layer 34 of the support board 30 comprises a keyhole-shaped aperture 42 corresponding to the keyhole-shaped aperture 38 of the bottom layer 32, first and second tracks 44, 46 described above, and void areas 48 that reduce the material usage and weight of the middle layer 34. Also, in the illustrative embodiment, the top layer 36 of the support board 30 comprises the first and second tracks 50, 60 described above, and the fastener apertures 70 for accommodating the foot fastener members 27.

In the illustrative embodiment, with collective reference to FIGS. 3 and 8, it can be seen that the chiropractic adjustment device 10 further comprises a plurality of rubber feet 26 mounted to the bottom of the support board 30 by foot fastener members 27. More specifically, referring to FIG. 8, each rubber foot 26 is secured to the support board 30 by a foot fastener member 27 (e.g., a bolt or screw 27) and a corresponding nut 28. In order to conceal the fasteners 27, 28 on the top layer 36, the support board 30 may be provided with board plug members 29 that fit within the fastener apertures 70 of the top layer 36 so as to conceal the fasteners 27, 28 from view. In addition to securing the rubber feet 26 to the support board 30, the foot fastener members 27 also secure the board layers 32, 34, 36 together.

In the illustrative embodiment, the bottom layer 32 of the support board 30 may be formed from a suitable plastic or wood (e.g., plywood), the middle layer 34 may be formed from a suitable plastic, and the top layer 36 may be formed from a suitable plastic or wood (e.g., birch plywood).

Figure 19:
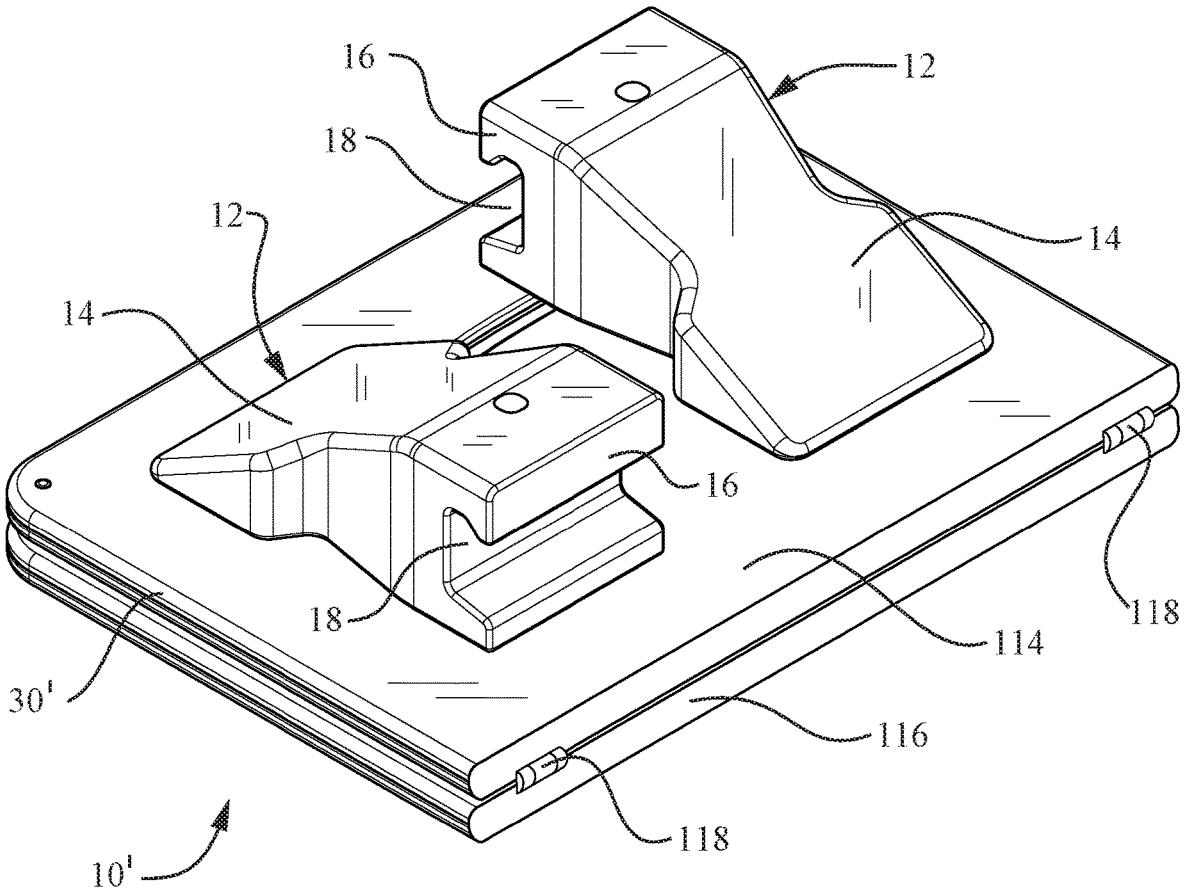
FIG. 19 is a perspective view depicting an alternative embodiment of the chiropractic adjustment device, wherein the support board of the chiropractic adjustment device is foldable for compact storage and/or transportation of the device.

An alternative embodiment of the chiropractic adjustment device 10' is depicted in FIG. 19. The chiropractic adjustment device 10' of FIG. 19 is similar in most respects to the chiropractic adjustment device 10' described above. However, unlike the chiropractic adjustment device 10 described above, the chiropractic adjustment device 10' of FIG. 19 has a foldable support board 30'. More specifically, as shown in FIG. 19, the support board 30 comprises a first board section 114 coupled to a second board section 116 by a pair of spaced-apart hinge members 118 so as to enable the support board 30' to be folded for compact storage and/or transportation of the chiropractic adjustment device 10'.

In one alternative embodiment, rather than the tracks 50, 60, the block positioning means of the chiropractic adjustment device 10, 10' may comprise a plurality of magnetic devices. In this alternative embodiment, a first one of the magnetic devices is configured to guide a first one of the adjustment blocks 12 along a first predetermined displacement path, and a second one of the magnetic devices is configured to guide a second one of the adjustment blocks 12 along a second predetermined displacement path.

In another alternative embodiment, rather than the tracks 50, 60, the block positioning means of the chiropractic adjustment device 10, 10' may comprise a plurality of electrical devices (e.g., electrical actuators). In this alternative embodiment, a first one of the electrical devices is configured to guide a first one of the adjustment blocks 12 along a first predetermined displacement path, and a second one of the electrical devices is configured to guide a second one of the adjustment blocks 12 along a second predetermined displacement path.

In yet another alternative embodiment, the chiropractic adjustment device 10, 10' may further include indicia printed or inscribed on the support board 30 so as to assist a user in following a self-treatment protocol. For example, the indicia of the support board 30 may comprise a belly button spot that indicates a proper positioning of the user's belly button on the board 30. In this alternative embodiment, the belly button spot is spaced in relation to the left side and right side tracks 50, 60. As another example, the indicia of the support board 30 may comprise marks for indicating the typical positions of the adjustment blocks 12.

In still another alternative embodiment, the chiropractic adjustment device 10, 10' may further include electrical stimulation pads in the support board 30 so that the chiropractic adjustment device 10, 10' may also be used for electrical stimulation therapy. In this alternative embodiment, the electrical stimulation pads in the support board 30 may be wirelessly coupled to an electrical power source so that electrical wires are not needed.

In yet another alternative embodiment, the chiropractic adjustment device 10, 10' may further include compliant foam cushions that are configured to lay on top of the adjustment blocks 12 so as to make the device 10, 10' more comfortable for the user.

Now, an exemplary manner in which chiropractic adjustment device 10, 10' is used to perform a pelvic adjustment will be described. First, the user adjusts the positions of the blocks 12 on the chiropractic adjustment device 10, 10' to address his or her particular pain. For left side pain, the second block 12 (i.e., right-side block 12) is positioned in one of the upper horizontal tracks 62, 64 at the level of the user's belly button. Depending on whether the user has a large or petite size pelvis, he or she selects either the first horizontal track 62 or the second horizontal track 64. Then, for left side pain, the first block 12 (i.e., left-side block 12) is positioned in the lower diagonal track 58 under the user's hip (see FIG. 10 configuration of the blocks 12). For right side pain, the first block 12 (i.e., left-side block 12) is positioned in one of the upper horizontal tracks 52, 54 at the level of the user's belly button. Depending on whether the user has a large or petite size pelvis, he or she selects either the first horizontal track 52 or the second horizontal track 54. Then, for right side pain, the second block 12 (i.e., right-side block 12) is positioned in the lower diagonal track 68 under the user's hip (see FIG. 9 configuration of the blocks 12). Then, the user lies faces down on the support board 30 with the adjustment blocks 12 under the pelvis. The user lies in a face-down position on the support board 30 in a manner that the belly button of the user aligns with a predetermined spot near the center of the board 30. Next, the user snugs the blocks 12 up under his or her torso. Finally, the user remains lying face down on the chiropractic adjustment device 10, 10' for a proper treatment time (e.g., 7 to 10 minutes per treatment session). An effective pelvic adjustment requires proper blocking along with a proper treatment time and gravity.

It is readily apparent that the aforedescribed chiropractic adjustment device 10, 10' offers numerous advantages. First, the chiropractic adjustment device 10, 10' is able to be used by a patient for self-treating the lumbosacral area, specifically the pelvic joints. In addition, the chiropractic adjustment device 10, 10' assists a patient in the proper positioning of adjustment blocks 12 for a self-administered pelvic adjustment. The adjustments performed using the aforedescribed chiropractic adjustment device 10, 10' help to provide relief and correction of musculoskeletal conditions in the pelvic area. Also, the specific configurations of the tracks 50, 60 on the support board 30 allow the chiropractic adjustment device 10, 10' to fit nearly any body size or shape (i.e., the device is generally universal).

Advantageously, the chiropractic adjustment device 10, 10' described above may be used for home chiropractic treatments. In particular, the chiropractic adjustment device 10, 10' enables the gravitational manipulation of the pelvis by the user. The support board 30 and associated blocks 12 provide for self-adjustment using the user's own body weight, time, and gravity. The tracks 50, 60 on the support board 30 assist the user with the proper positioning of the blocks 12 based on the user's personal body/pelvis size. The blocks 12 adjustably translate along the predetermined paths defined by the tracks 50, 60 on the support board 30 to specific resting positions that are defined on the board 30. The aforedescribed chiropractic adjustment device 10, 10' allows for proper set-up of the blocks 12 for gravitational manipulation. To be effective, the chiropractic adjustment of the pelvis requires proper blocking together with the user maintaining the adjustment position for an adequate period of time. The aforedescribed chiropractic adjustment device 10, 10' advantageously enables a single user, or one person assisting another person, to perform one specific setup of the sacro-occipital technique blocking (i.e., SOT blocking) at home without the presence of a licensed chiropractor.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A chiropractic adjustment device, comprising:

a support board;

a plurality of adjustment blocks slidably coupled to the support board, each of the adjustment blocks having a wedge-shaped body portion; and block positioning means, the block positioning means configured to establish predetermined displacement paths for each of the adjustment blocks so as to assist a user in the proper positioning of the adjustment blocks for a self-administered pelvic adjustment of the user, the predetermined displacement paths including a first predetermined displacement path and a second predetermined displacement path, and the block positioning means including a plurality of tracks disposed in the support board, a first one of the tracks configured to establish the first predetermined displacement path for a first one of the adjustment blocks, and a second one of the tracks configured to establish the second predetermined displacement path for a second one of the adjustment blocks, each of the plurality of tracks including a straight track portion and a diagonal track portion.

2. The chiropractic adjustment device according to claim 1, further comprising a plurality of connector members, each of the connector members configured to couple a respective one of the adjustment blocks to the support board.

3. The chiropractic adjustment device according to claim 1, wherein at least one of the plurality of adjustment blocks comprises a handle portion for facilitating a grasping of the adjustment block by the user during the positioning of the adjustment block.

4. The chiropractic adjustment device according to claim 1, wherein at least one of the plurality of adjustment blocks comprises a hand recess formed therein for facilitating a grasping of the adjustment block by the user during the positioning of the adjustment block.

5. The chiropractic adjustment device according to claim 1, wherein each of the plurality of tracks further comprise a curved track portion.

6. The chiropractic adjustment device according to claim 1, wherein the plurality of tracks are configured so as to enable one of the adjustment blocks to be diagonally oriented relative to the other of the adjustment blocks.

7. The chiropractic adjustment device according to claim 1, wherein the support board comprises a first board section coupled to a second board section by a hinge member so as to enable the support board to be folded for compact storage and/or transportation of the chiropractic adjustment device.

8. A chiropractic adjustment device, comprising:

a support board;

a plurality of adjustment blocks slidably coupled to the support board, each of the adjustment blocks having a wedge-shaped body portion; and a plurality of tracks disposed in the support board, each of the tracks configured to establish a predetermined displacement path for a respective one of the adjustment blocks so as to assist a user in the proper positioning of the adjustment blocks for a self-administered pelvic adjustment of the user, each of the plurality of tracks including a straight track portion and a diagonal track portion, the straight track portion being spaced apart from the diagonal track portion.

9. The chiropractic adjustment device according to claim 8, further comprising a plurality of connector members, each of the connector members configured to couple a respective one of the adjustment blocks to the support board.

10. The chiropractic adjustment device according to claim 8, wherein at least one of the plurality of adjustment blocks comprises a handle portion for facilitating a grasping of the adjustment block by the user during the positioning of the adjustment block.

11. The chiropractic adjustment device according to claim 8, wherein at least one of the plurality of adjustment blocks comprises a hand recess formed therein for facilitating a grasping of the adjustment block by the user during the positioning of the adjustment block.

12. The chiropractic adjustment device according to claim 8, wherein each of the plurality of tracks further comprise a curved track portion.

13. The chiropractic adjustment device according to claim 8, wherein the plurality of tracks are configured so as to enable a first one of the adjustment blocks to be diagonally oriented relative to a second one of the adjustment blocks.

14. The chiropractic adjustment device according to claim 13, wherein the first one of the adjustment blocks is configured to be diagonally oriented relative to the second one of the adjustment blocks at an approximately 45 degree angle.

15. The chiropractic adjustment device according to claim 8, wherein the support board comprises a first board section coupled to a second board section by a hinge member so as to enable the support board to be folded for compact storage and/or transportation of the chiropractic adjustment device.

* * * * *